US008739761B2

(12) United States Patent
Chini

(10) Patent No.: US 8,739,761 B2
(45) Date of Patent: Jun. 3, 2014

(54) VALVE DEVICE WITH AT LEAST TWO SEPARATELY PRODUCED VALVES ASSEMBLED TOGETHER FOR JOINT MOVEMENT

(75) Inventor: Fabrizio Chini, Isera (IT)

(73) Assignee: Rochling Automotive AG & Co. KG, Mannheim (DE)

( * ) Notice: Subject to any disclaimer, the term of this patent is extended or adjusted under 35 U.S.C. 154(b) by 0 days.

(21) Appl. No.: 13/584,051

(22) Filed: Aug. 13, 2012

(65) Prior Publication Data

US 2013/0037000 A1 Feb. 14, 2013

(30) Foreign Application Priority Data

Aug. 12, 2011 (EP) ..... 11177435

(51) Int. Cl.
*F02D 9/10* (2006.01)

(52) U.S. Cl.
USPC ..... 123/336; 123/337; 251/304

(58) Field of Classification Search
USPC ..... 123/336, 337; 251/304
See application file for complete search history.

(56) References Cited

U.S. PATENT DOCUMENTS

| | | | | |
|---|---|---|---|---|
| 3,897,524 | A | 7/1975 | Freismuth | |
| 5,427,141 | A | 6/1995 | Ohtsubo | |
| 8,056,534 | B2 * | 11/2011 | Magnan et al. | 123/336 |
| 8,327,824 | B2 * | 12/2012 | Takeda et al. | 123/306 |
| 8,387,581 | B2 * | 3/2013 | Goldin et al. | 123/184.55 |
| 2002/0056824 | A1 | 5/2002 | Rentschler | |
| 2002/0175308 | A1 * | 11/2002 | Leyendecker et al. | 251/305 |
| 2007/0044754 | A1 * | 3/2007 | Peffley et al. | 123/306 |
| 2007/0084437 | A1 * | 4/2007 | Winkelmuller et al. | 123/336 |
| 2007/0256662 | A1 * | 11/2007 | Confer et al. | 123/308 |
| 2008/0035107 | A1 * | 2/2008 | Torii | 123/336 |
| 2008/0271697 | A1 * | 11/2008 | Vichinsky | 123/184.56 |
| 2012/0312275 | A1 * | 12/2012 | Eisele et al. | 123/336 |

FOREIGN PATENT DOCUMENTS

| | | | |
|---|---|---|---|
| EP | 1505281 | B1 | 2/2005 |
| WO | 9301402 | A1 | 1/1993 |
| WO | 2006024468 | A1 | 3/2006 |

* cited by examiner

*Primary Examiner* — Erick Solis
(74) *Attorney, Agent, or Firm* — Rothwell, Figg, Ernst & Manbeck P.C.

(57) ABSTRACT

A valve device (110), in particular a throttle device, preferably for use in motor vehicles, the finished valve device (110) comprising a housing (120), which surrounds a flow duct portion (126, 128, 130, 133), and additionally comprising at least two valves (132, 134, 136, 137) accommodated on the housing (120) and movable relative thereto such that, by relative adjustment of the valves (132, 134, 136, 137) relative to the housing (120), the effective flow area of the flow duct portion (126, 128, 130, 133) may be modified, adjacent valves (132, 134, 136, 137) being produced separately and being couplable or coupled together for joint movement by interlocking geometries (164, 166).

14 Claims, 3 Drawing Sheets

VALVE DEVICE WITH AT LEAST TWO SEPARATELY PRODUCED VALVES ASSEMBLED TOGETHER FOR JOINT MOVEMENT

The present invention relates to a valve device, in particular a throttle device, preferably for use in motor vehicles, the valve device comprising a housing, which surrounds a flow duct portion, and additionally comprising at least two valves accommodated on the housing and jointly movable relative thereto such that, by relative adjustment of the valves relative to the housing, the effective flow area of the flow duct portion may be modified.

The above-stated valve device, which may comprise a plurality of valves and as a rule one flow duct portion per valve, is preferably suitable for use in motor vehicles, in order to modify gas flows of all kinds, such as for instance a fresh gas feed to the internal combustion engine, with regard to quantity by relative adjustment of the at least two valves relative to the housing. It is known, moreover, to produce components of such a valve device, such as for example the valves on the one hand and the housing on the other hand, inexpensively using injection moulding.

A disadvantage of production by injection moulding of a plurality of valves connected together for joint movement is that a degree of deformation may arise after demoulding of a valve assembly with a plurality of, in any case at least two, valves from an injection mould.

When in particular the valve assembly is to be accommodated in the housing of the valve device rotatably about a valve axis, the valves are generally arranged in a row in the axial direction, whereby the valve assembly may be very long in the axial direction. Since the deformation arising as a result of thermal distortion and of possible warpage after demoulding from the injection mould generally increases with increasing size in one spatial direction, straight valve assemblies with at least two or even more valves are subject to a particularly undesirable degree to the above-described geometric change after demoulding.

Since this geometric change (deformation) suffered by the element after demoulding may lead to problems in realizing relative motion of the valve assembly relative to the housing bearing it, the object of the present invention is to develop further the initially stated valve device in such a way that a valve device with at least two valves with improved dimensional stability may be provided, also by injection moulding, such that intended operation of the valve device, in particular in terms of relative motion between valve assembly and housing, may proceed more trouble-freely than previously even in an injection-moulded valve assembly with at least two valves.

According to the present invention, this object is achieved by a valve device of the above-mentioned type, in which adjacent valves are produced separately and are couplable or coupled together for joint movement by interlocking geometries.

This means that the valves which are connected together in the finished valve device for joint relative adjustment relative to the housing, are produced individually, i.e. separately from one another, and coupled together only after production thereof. Therefore, the individual ones of a plurality of valves may still be uncoupled in the semi-finished product, but couplable together by interlocking geometries, or may already be coupled together for joint movement.

The housing may likewise consist of a plurality of housing parts, for instance of one housing part per valve. It is however likewise conceivable to combine together a plurality of or even all the flow duct portions substantially in a common housing part and merely to add further assembly parts, so as to allow mounting of the valves on the housing part in a manner permitting relative motion.

When the at least two valves on the finished valve device are provided on the housing so as to be rotatable relative thereto about a valve axis, —or alternatively a translationally movable valve may also be conceivable—, it is advantageous for the valve to comprise a valve body and at least one valve shaft portion connected thereto for joint movement. The valve body is then preferably that portion of the valve with which the above-described modification of the flow area is brought about by changing the relative arrangement and which is configured for this purpose.

The term "flow area" in this application in particular but not exclusively designates a flow area in a plane orthogonal to the direction of flow.

The valve shaft portion, which is preferably in one piece with the valve body for reasons of stability with regard to dimensions and shape and to avoid undesired assembly effort, is then preferably configured to accommodate the valve with the valve body rotatably on the housing.

Particularly stable support of the valve for relative rotation relative to the housing may be achieved in that the valve comprises two valve shaft portions substantially collinear relative to the valve axis, the valve body being provided axially between the valve shaft portions. By arranging the valve body axially between the valve shaft portions, it is moreover possible to prevent or at least considerably reduce valve bending resulting from loads which may arise during operation, which bending could otherwise impair the relative rotatability of the valve relative to the housing.

In many cases, the valve device or a semi-finished product made for production thereof may comprise more than two valves, for instance if a plurality of similar flow ducts lead to each cylinder of a multicylinder internal combustion engine and the gas flow quantity or gas flow rate respectively in each of the flow ducts needs to be variable.

A structurally simple solution which significantly simplifies subsequent assembly work may be such that one of two valve shaft portions connected to a valve body comprises a coupling geometry, preferably at a free axial end thereof, and the respective other valve shaft portion comprises a counter coupling geometry, the coupling geometry and the counter coupling geometry being couplable in interlocking manner for joint rotational movement about the valve axis.

Thus, each valve preferably has a coupling geometry at one end and a counter coupling geometry at the other end, such that only one type of valve needs to be produced and this valve may be arranged axially in a row by coupling geometry and counter coupling geometry as many times as desired, in order to achieve the desired number of valve in the respective valve assembly.

From an advantageous standpoint with regard to manufacturing, the coupling geometry and/or the counter coupling geometry is preferably in one piece with the valve comprising it, preferably with the valve shaft portion comprising it.

Safe and reliable torque transmission from one valve to the respectively axially adjacent valve, which may be a prerequisite for joint movement, may be achieved in a simple manner in that one geometry of coupling geometry and counter coupling geometry comprises a recess and the respective other geometry comprises a torque-transmitting projection introducible into the recess, preferably a projection complementary to at least one portion of the recess circumference. By appropriate selection of the axial length of recess and projection, the load per unit area of coupling geometry and counter coupling geometry arising at the torque-transmitting coupling location may be kept low.

For example, for torque transmission purposes the projection, like the recess, may have a cross-sectional shape which, with regard to a cross section orthogonal to the valve axis, is bounded by a polygonal line. In general, the projection may be of prismatic construction, wherein projection and recess may comprise insertion bevels to simplify assembly. This means that the projection tapers with increasing axial distance from the valve body, while the recess tapers as it approaches the valve body.

The preferred complementary construction of recess and projection should not mean that, when recess and projection are in the coupled state, there are no longer any spaces in the coupling structure, since the recess must conventionally always be a little longer, axially, than the projection. Rather it should be expressed that after coupling the majority of the recess is occupied by the material of the projection.

To actuate the valve arrangement in the valve device, it is advantageous for the valve device to comprise an actuating element with which an actuating torque for relative rotation of valves and housing may be introduced into the valve device by an actuating device, for instance an actuator, in order thereby to be able to actuate the valve arrangement of the valve device at a single actuating location.

The actuating element may already be connected to at least one valve of the valve device or still be connectable thereto. To simplify assembly work, but also for use of a substantially "universal" valve, not only for coupling to another valve, but also for coupling to the actuating element, it is then advantageous for the actuating element also to comprise a geometry consisting of coupling geometry and counter coupling geometry.

The possibility of coupling together a plurality of individually produced valves by means of the above-stated interlocking geometries should not rule out the possibility of their additionally being connected together operationally non-detachably by bonding, for instance by laser welding, which produces particularly low levels of warping, or by adhesion or otherwise, in order to be able to ensure operation of the valve device with maximally accurate modification of the gas flow quantity or gas flow rate respectively through the flow duct portion.

The above-mentioned valve axis may be arranged such that it passes substantially through the valve body, i.e. for instance as in known butterfly valves. It is likewise conceivable for the valve axis to be provided at a distance from the valve body, the valve body then advantageously being of curved construction, such that, in a passage position in which the flow area of the flow duct portion is at its maximum, the valve body may abut against the inner wall of the housing or fit closely thereagainst in a low distance.

In the former case of a butterfly valve, this is advantageously planar, i.e. extends along a plane, for reasons of maximally simple manufacture.

To provide maximally precise relative motion, i.e. that is stable with regard to shape and/or dimensions, between valve and housing, it may be advantageous, when the valve in the finished valve device is provided on the housing rotatable relative thereto about a valve axis, for at least one valve, preferably all the valves, of a valve arrangement of a valve device to comprise one valve shaft element.

The valve shaft element may for example be a metal element or an element of another material, which is more stable with regard to shape than the cured moulding material of the valve.

It is then possible to mould, in particular injection mould, the valve onto the valve shaft element, or to encapsulate by (over)moulding, in particular to encapsulate by injection moulding, the valve shaft element with the valve.

In the former case of moulding the valve onto the valve shaft element, the latter is not completely surrounded by moulding material contributing to formation of the valve, while in the case of encapsulation by (over)moulding, the valve shaft element is completely surrounded by moulding material contributing to formation of the valve.

Encapsulation by (over)moulding is preferred, since the encapsulated valve shaft element is on the one hand largely protected by the moulding material of the valve and moreover no undesirable material pairing arises at the outer face of the valve reinforced with the valve shaft element, which material pairing could lead to undesired wear on relative motion of valve and housing.

For the purpose of differentiation it should be emphasised that jointly injection moulding or encapsulation by injection moulding two or more valves on a common valve shaft element by injection moulding them on or encapsulating them does not constitute an interlocking geometry connection for the purposes of the present application. Instead, the valves of the valve device according to the invention must be separate at the beginning of assembly of the valve arrangement.

Adjacent valves are preferably connected or connectable for joint movement by an axial plug and socket connection.

To improve the weldability of adjacent valves, the interlocking geometries and the adjoining valve shaft portion region preferably have a surface of a uniform material. Preferably, the entire valve is made from this material.

The present invention is explained in greater detail below with reference to the attached Figures, in which:

FIGS. 1 to 3 show an embodiment of the present invention designated overall as 110.

Figure 1:
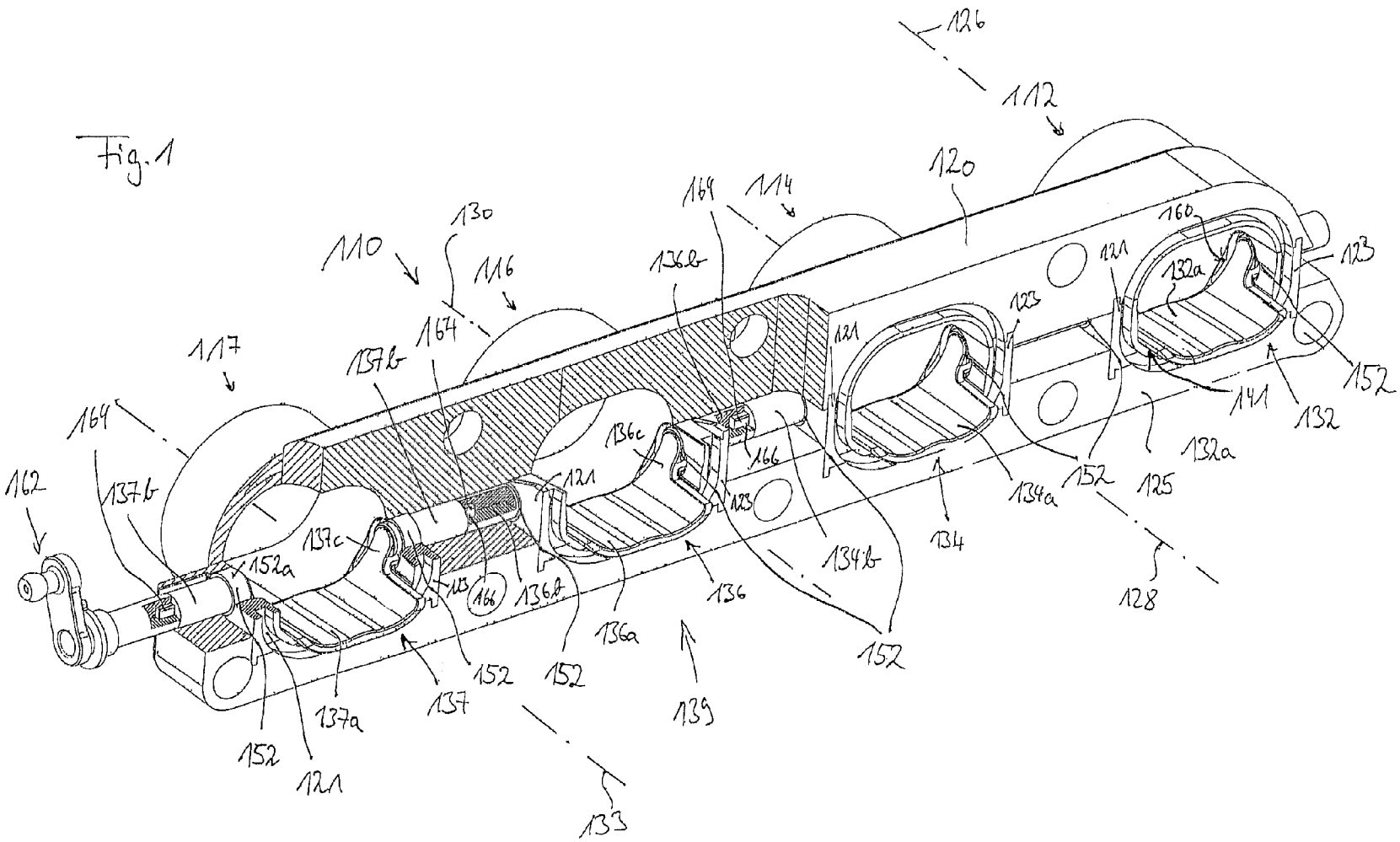
FIG. 1 is a perspective, partially sectional view of one embodiment of a valve device according to the invention.

The valve device 110 shown here comprises four substantially parallel flow duct portions 126, 128, 130 and 133, which may be formed in a common housing 120.

Alternatively, the housing 120 may be subdivided in such a manner that one or more subgroups of flow duct portions are formed in one housing part. It may likewise be conceivable to form a separate housing for each flow duct portion.

As is explained in greater detail further below, the housing 120 may be of multipart construction to simplify assembly of the embodiment of a valve device 110 shown herein.

The valves 132, 134, 136 and 137 may be constructed with curved valve bodies 132*a*, 134*a*, 136*a* and 137*a* corresponding to the shape of the associated flow duct portion, which are then preferably arranged at a distance from the valve axis K, around which the entire valve arrangement 139 may be rotated relative to the housing 120. In the passage position shown in FIG. 1, the valve bodies 132*a*, 134*a*, 136*a* and 137*a* then preferably lie close against the housing 120, forming a narrow gap 141.

In the passage position shown in FIG. 1, in which the respective flow duct portions in the housing 120 have a substantially maximum flow area, the valve bodies may then fit snugly against the respective inner wall portions of the housing 120. Thus, in the passage position of the valve arrangement 139 there is preferably no valve component projecting into the flow duct portion associated therewith.

The second embodiment discussed here of a valve device 110 according to the invention will be described below with reference to the valve 137 on the far left in FIG. 1. Where other valves than the described valve 137 differ therefrom, in the context of this description reference may be made specifically to the differences.

The valve 137 comprises the already stated valve body 137*a*, from which valve shaft portions 137*b* project on both with respect to the valve axis K axial sides.

The valve shaft portions 137*b* are preferably formed integrally with the valve body 137*a* by way of web portions 137*c*.

Both longitudinal ends of the valve shaft portions 137*b* remote from the valve body 137*a* may comprise interlocking geometries which may serve as torque-transmitting connection with the respective adjacent valve, here for example valve 136, and/or with an actuating element 162.

In the example shown in FIG. 1 both interlocking geometries may be formed as projections 164.

Valves 137 and 134 may then be formed substantially identical, and valves 136 and 132 may be formed substantially identical, the difference between adjacent valves 137 and 136 (see FIG. 3) possibly being that the valve 136 comprises coupling recesses 166 instead of projections 164.

In the example illustrated, at both longitudinal ends of the valve shaft portions 136*b* remote from the valve body 136*a* the valve 136 has recesses 166 into which the projections 164 of adjacent valves may be introduced in axial direction, in order to connect the valves together in a torque-transmitting manner.

Figure 2:
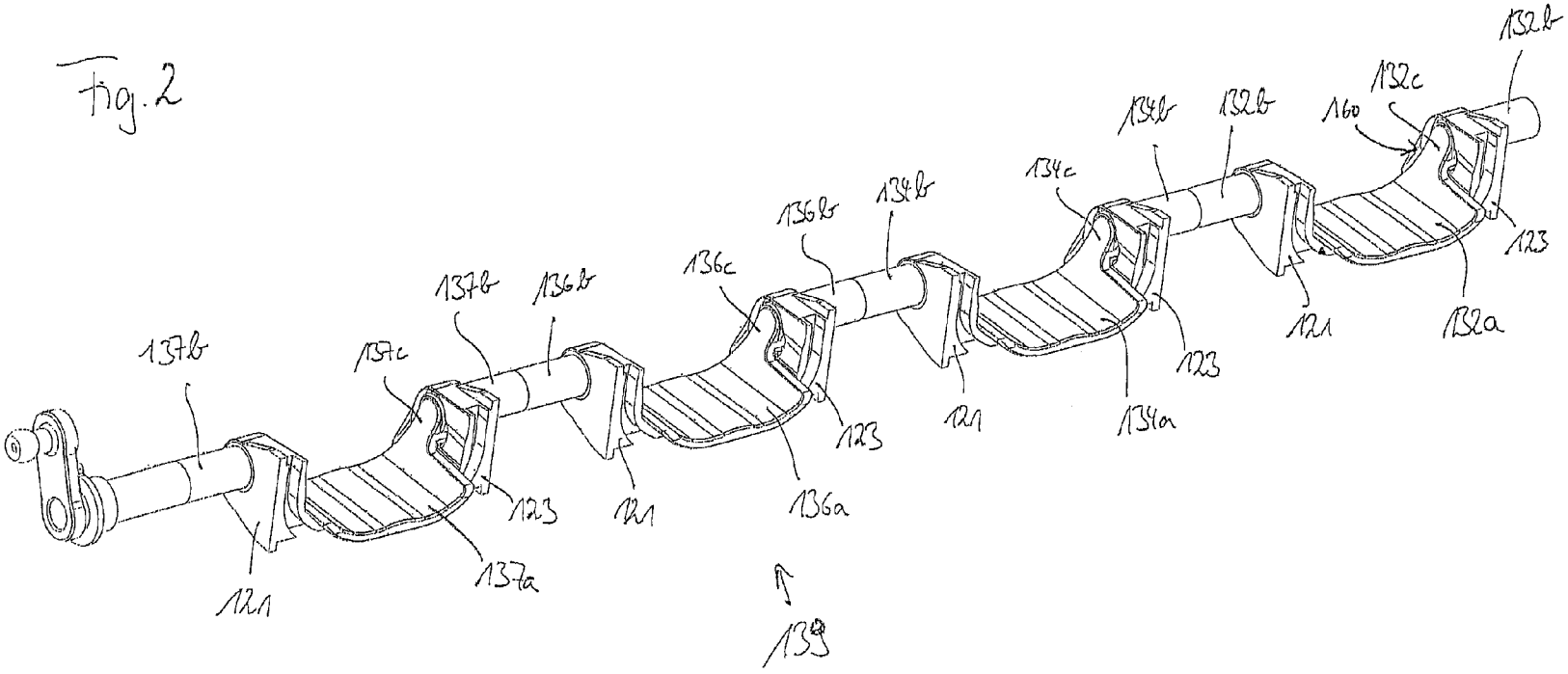
FIG. 2 is a perspective representation of the valves, bearing bushes and actuating element of the valve device of the embodiment of FIG. 1.
Figure 3:
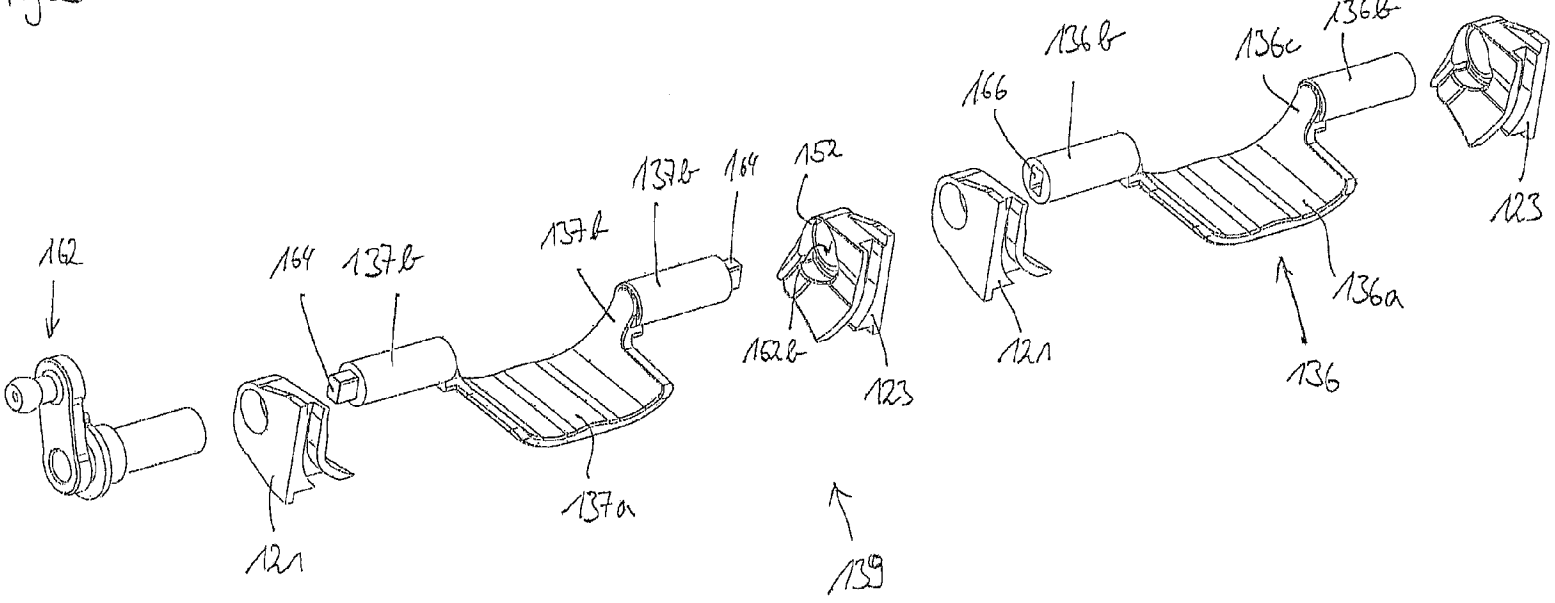
FIG. 3 is an exploded view of the two valves of the valve assembly of FIG. 2 lying axially closest to the actuating element.

The situation illustrated in FIGS. 1 to 3 may be modified with regard to required assembly in that each valve has a projection 164 at one longitudinal end of a valve shaft portion and a corresponding recess 166 at the respective other longitudinal end. If, in terms of the position relative to the valve body, the same valve shaft portions then always comprise a projection and the respective other ones comprise a recess, it is sufficient to manufacture one kind of valve. Substantially identical valves may thus be plugged together to form a valve arrangement 139.

Once adjacent valves and/or an actuating element 162 have been plugged together, the components plugged for torque transmission may be additionally joined together by adhesion, welding or any other desired suitable method so as to be non-detachable when used as intended.

A laser welding method is here preferably recommended, which minimises the arising thermal warping which may arise and thus ensures the greatest possible dimensional stability, in conjunction with smooth relative rotatability of the valve arrangement 139 relative to the housing 120.

It is likewise conceivable, although not preferred due to the greater assembly effort, to construct all the valves with coupling recesses 166 and to introduce separately constructed connecting blocks in the form of the coupling projections 164 into the coupling recesses 166 of adjacent valves. Although in this solution too all the valves are then substantially geometrically identical, the assembly effort resulting from introduction of the coupling blocks is undesirably high.

The coupling projections 164 are preferably of prismatic structure, such that, when combined with the corresponding coupling recesses 166, they can transmit torque at the sides of their circumferential surface. In the example illustrated, the coupling projections 164 are designed as cuboids. However, it is likewise conceivable to design the coupling projections 164, as a triangular prism, a penta-gonal prism or an irregular prism.

It is likewise sufficient to form the recesses 166 in such a way that portions of the inner circumferential surface of a recess 166 come to bear against portions of the circumferential surface of the coupling projections 164 and at this bearing point a torque about the valve axis K is transmittable between two valves coupled in this way.

However, to achieve an as exact as possible geometry of the assembled valve arrangement 139, it is preferable for valve projections 164 and valve recesses 166 substantially to complete one another when assembled, i.e. to be of mutually complementary construction, wherein this is not intended to mean that the coupling recess 166 is completely filled by the coupling projection 164 when being in a state combined with a coupling projection 164. Conventionally, already for manufacturing reasons, the coupling recess 166 is formed axially longer than the coupling projection 164. However, it is advantageous for coupling projection 164 and coupling recess 166 to have at least one axial portion in which virtually the entire circumference of a coupling projection 164 rests against the circumference of the coupling recess 166.

In this way, the valves may be manufactured individually and assembled with little effort into a valve arrangement 139 of any desired length.

The valve assembly 139, which in FIGS. 1 and 2 comprises four valves and one actuating element 162, may in alternative embodiments, as shown in FIG. 3, comprise just two valves 137 and 136 and one actuating element 162 or may comprise just three, five, six or more valves, in each case with or without an actuating element 162.

As is likewise shown in the Figures, the actuating element also has a corresponding interlocking geometry, in this case a coupling recess 166.

As shown in FIGS. 2 and 3, each valve shaft portion may be surrounded by an supplementary housing element 121 or 123.

The supplementary housing elements 121 or 123 may be substantially identical and differ merely in terms of their direction of curvature. For example, the supplementary housing elements 121 and 123 may be mirror-symmetrical relative to a mirror plane of symmetry orthogonal to the duct axis K.

When each valve has its associated supplementary elements 121 and 123, the valves needed to form a valve arrangement 139 may be combined together in torque-transmitting manner by way of the above-described interlocking geometries and preferably fixed together non-detachably. The same applies to an actuating element 162, which may be connectable to the end of the valve arrangement 139 in torque-transmitting manner. Then the valve arrangement 139 formed in this way may be inserted into the basic housing element 125, which is shown in FIG. 1, wherein the respective supplementary housing elements 121 and 123 then complete the basic housing element 125 to form a housing with complete flow duct portions.

Between the supplementary housing elements 121 or 123 and the valve shaft portions 137*b*, 136*b*, 134*b*, 132*b* passing through them, a bearing bush 152 may be provided to improve the relative mobility of valve and housing.

In the present case the valves, for example the valve 137, may be moulded, for example by injection moulding, in a common mould in a common moulding step with the supplementary housing elements 121 and 123. To this end, a set of bearing bushes 152, which after demoulding separate the supplementary housing elements 121 and 123 geometrically from the valve shaft portions 137*b* etc., was preferably inserted into the mould at corresponding locations in the mould prior to the moulding step and encapsulated with moulding material, in particular encapsulated by injection moulding.

The supplementary elements thus abut against an outer surface 152*a* of the bearing bush 152, while the valve shaft portions 137*b* abut against an inner surface 152*b* (see FIG. 3) of the bearing bushes 152.

The invention claimed is:

1. A valve device comprising:

a housing surrounding a flow duct portion; and at least two valves accommodated on the housing and movable relative thereto such that adjustment of the valves relative to the housing modifies the effective flow area of the flow duct portion;

wherein adjacent valves of the at least two valves are produced separately and are couplable or coupled together for joint movement by interlocking geometries;

wherein at least one of the at least two valves comprises:

at least one valve shaft portion, with which the valve is rotatably supported on the housing; and a valve body, which is accommodated in the flow duct portion so as to modify the flow area; and wherein the at least one valve shaft portion is constructed in one piece with the valve body.

2. The valve device according to claim 1, wherein at least one of the at least two valves comprises two valve shaft portions that are substantially coaxial relative to the valve axis of the at least one valve; and wherein the valve body is provided axially between the two valve shaft portions.

3. The valve device according to claim 1, wherein one of two valve shaft portions connected to the valve body comprises a coupling geometry;

wherein the respective other valve shaft portion comprises a counter coupling geometry; and wherein the coupling geometry and the counter coupling geometry are couplable in interlocking manner for joint rotational movement about the valve axis.

4. The valve device according to claim 3, wherein one geometry of the coupling geometry and counter coupling geometry comprises a recess; and wherein the respective other geometry comprises a torque-transmitting projection introducible into the recess.

5. The valve device according to claim 3, wherein the valve device comprises;

an actuating element, which may be or is connected to at least one valve to introduce an actuating moment for relative rotation of the valves and the housing;

wherein the actuating element comprises one geometry out of the coupling geometry and the counter coupling geometry.

6. The valve device according to claim 1, wherein in addition to the provided interlocking geometries, a plurality of individually produced valves are connected together operationally non-detachably.

7. A valve for a valve device according to claim 1.

8. The valve device according to claim 1, wherein the valve device is in the form of a throttle device for use in motor vehicles.

9. The valve device according to claim 3, wherein the coupling geometry is located at a free axial end of its respective valve shaft portion.

10. The valve device according to claim 4, wherein the torque-transmitting projection is complementary to at least one portion of the recess circumference.

11. The valve device according to claim 6, wherein the plurality of individually -produced valves are connected together operationally non-detachably by bonding.

12. The valve device according to claim 6, wherein the plurality of inidvidually produced valves are connected together operationally non-detachably by laser welding.

13. The valve device according to claim 6, wherein the plurality of individually produced valves are connected together operationally non-detachably by adhesion.

14. The valve device according to claim 1, wherein a rotational axis of at least one of the at least two valves is provided at a distance from the valve body of the valve; and wherein the valve body of the at least one of the at least two valves is shaped so as to fit closely or abut an inner wall surface of the housing in order to maximize the flow area of the flow duct portion when the valve is rotated to a fully open position.

* * * * *